US011493249B2

(12) United States Patent
Nakagawa et al.

(10) Patent No.: US 11,493,249 B2
(45) Date of Patent: Nov. 8, 2022

(54) REFRIGERANT CHARGE DEVICE AND REFRIGERANT CHARGE SYSTEM HAVING THE SAME

(71) Applicant: Samsung Electronics Co., Ltd., Suwon-si (KR)

(72) Inventors: Tadahiro Nakagawa, Kanagawa (JP); Hiroaki Eguchi, Kanagawa (JP); Masatoshi Takahashi, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/920,264

(22) Filed: Jul. 2, 2020

(65) Prior Publication Data

US 2021/0003332 A1 Jan. 7, 2021

(30) Foreign Application Priority Data

Jul. 4, 2019 (JP) ..... JP2019-124975
Feb. 6, 2020 (KR) ..... 10-2020-0014298

(51) Int. Cl.
*F25B 45/00* (2006.01)
*F25B 49/02* (2006.01)
(Continued)

(52) U.S. Cl.
CPC ..... *F25B 45/00* (2013.01); *F25B 40/04* (2013.01); *F25B 40/06* (2013.01); *F25B 41/20* (2021.01);
(Continued)

(58) Field of Classification Search
CPC ..... F25B 45/00; F25B 2345/001; F25B 2345/003; F25B 2345/006; F25B 2600/05; F25B 2600/2515; F25B 2700/04; F25B 2700/1931; F25B 2700/2106; F25B 2700/21152
See application file for complete search history.

(56) References Cited

U.S. PATENT DOCUMENTS 4,110,998 A * 9/1978 Owen ..... F25B 43/00 62/125
4,755,957 A * 7/1988 White ..... B60H 1/00585 62/126
(Continued)

FOREIGN PATENT DOCUMENTS

JP 6306450 B2 4/2018
JP 2018-105597 A 7/2018
KR 10-2007-0101897 A 10/2007
KR 10-2010-0034080 A 4/2010

*Primary Examiner* — Jonathan Bradford

(57) ABSTRACT

A refrigerant charging device and a refrigerant charging system include a refrigerant charging flour path having a refrigerant charging port connected to a refrigerant flow path of an air conditioner, a valve provided at the refrigerant charging flow path, and a control device configured to control the valve. The control device includes a discharging superheat calculator configured to calculate the discharging superheat degree from a refrigerant temperature and a refrigerant pressure at a discharge side of a compressor, and a valve controller configured to control the opening and closing state of the valve based on the calculated discharging superheat degree calculated by the discharge super-heat calculator.

14 Claims, 11 Drawing Sheets

(51) Int. Cl.

| | |
|---|---|
| ***F25B 43/00*** | (2006.01) |
| ***F25B 40/06*** | (2006.01) |
| ***F25B 40/04*** | (2006.01) |
| ***F25B 41/20*** | (2021.01) |

(52) U.S. Cl.

CPC ..... *F25B 43/003* (2013.01); *F25B 49/02* (2013.01); *F25B 2313/008* (2013.01); *F25B 2345/001* (2013.01); *F25B 2345/003* (2013.01); *F25B 2345/006* (2013.01); *F25B 2600/05* (2013.01); *F25B 2600/2515* (2013.01); *F25B 2700/04* (2013.01); *F25B 2700/1931* (2013.01); *F25B 2700/2106* (2013.01); *F25B 2700/21152* (2013.01)

(56) References Cited

U.S. PATENT DOCUMENTS

| | | | | | |
|---|---|---|---|---|---|
| 4,765,149 | A * | 8/1988 | Shiga | F25B 45/00 | 62/324.4 |
| 5,557,940 | A * | 9/1996 | Hendricks | F17C 7/00 | 62/149 |
| 5,934,094 | A * | 8/1999 | Itoh | B60H 1/3205 | 62/222 |
| 9,303,907 | B2 * | 4/2016 | Kawano | F25B 45/00 | |
| 2007/0089440 | A1 * | 4/2007 | Singh | F25B 49/005 | 62/129 |
| 2009/0013702 | A1 * | 1/2009 | Murakami | F25B 13/00 | 62/118 |
| 2014/0174114 | A1 * | 6/2014 | Tamaki | F25B 45/00 | 62/129 |

* cited by examiner

REFRIGERANT CHARGE DEVICE AND REFRIGERANT CHARGE SYSTEM HAVING THE SAME

CROSS-REFERENCE TO RELATED APPLICATIONS

This application is based on and claims priority under 35 U.S.C. § 119 to Korean Patent Application No. 10-2020-0014298 filed on Feb. 6, 2020 in the Korean Intellectual Property Office, and Japanese Patent Application No. 2019-124975 filed on Jul. 4, 2019 in the Japan Patent Office, the disclosures of which are herein incorporated by reference in their entirety.

BACKGROUND

1. Field

Embodiments of the disclosure relate to a refrigerant charge device for charging a refrigerant in an air conditioner and a refrigerant charge system having the same.

2. Description of the Related Art

In the case of replacing an air conditioner, it is common for a contractor to calculate a charge amount of a refrigerant from the number of indoor units or piping volume and manually charge the refrigerant, but when there is an error in calculating the charge amount, insufficient refrigerant or overcharge occurs.

In order to solve such a limitation, Patent Document 1 proposes a refrigerant automatic charging technique for automatically charging a refrigerant.

As a technique for controlling the automatic charging of the refrigerant, there is a technique for charging the refrigerant while detecting the amount of the refrigerant flowing in the air conditioner. Such a technology has a limitation in that a compressor fails due to a liquid-back to the compressor when detecting the amount of the refrigerant. In order to prevent the reliability from deteriorating due to the compressor failure, it is required to stabilize the condition of the air conditioner, but in this case, the refrigerant cannot be charged at high speed.

Therefore, as a measure of improving a charging speed of the refrigerant while preventing the liquid-back, as shown in Patent Document 1, a pressure reducing device (also referred to as a Shibari device in Japan, an expansion valve in a refrigeration cycle) is provided in a charge flow path through which the refrigerant to be filled flows. There is a technique to regulate an opening degree of the pressure reducing device so that a charge flow rate is properly adjusted based on a discharging superheat degree of the compressor. However, when using such pressure reducing device, the manufacturing cost of the entire device increases.

SUMMARY

Therefore, it is an aspect of the disclosure to provide a refrigerant charging system and a refrigerant charging device to solve the above-described problems, and at the same time to improve a charging speed of a refrigerant while reducing the cost and preventing the liquid back with providing a highly reliable.

Additional aspects of the disclosure will be set forth in part in the description which follows and, in part, will be obvious from the description, or may be learned by practice of the invention.

In accordance with an aspect of the disclosure, a refrigerant charging device for charging a refrigerant in a refrigerant flow path of an air conditioner includes: a refrigerant charging port connected to the refrigerant flow path; an on/off valve for regulating the supply of the refrigerant; a communicator performing communication with the air conditioner; and at least one processor configured to obtain a discharging superheat degree of the refrigerant in the air conditioner from a refrigerant pressure and a refrigerant temperature at a discharge side of a compressor of the air conditioner received through the communicator, and control opening and closing of the on/off valve based on the obtained discharged superheat.

According to the refrigerant charging device configured as described above, since the opening and closing of on/off valve is controlled according to the calculated discharging superheat, when the discharged superheat degree can be ensured high, the charging speed is improved by continuing to charge the refrigerant, for example, for a predetermined time with the on/off valve open.

On the other hand, when the discharging superheat degree falls below a predetermined threshold within this predetermined time, the charging of the refrigerant can be stopped before liquid-back occurs by closing the on/off valve.

As described above, according to the refrigerant charging device, despite a low-cost configuration of the on/off valve, it is possible to improve the charging speed, and furthermore, it is possible to prevent liquid-back, thereby ensuring reliability.

As a specific form of stopping the charging of the refrigerant before the liquid-back occurs, the at least one processor may close the on/off valve when the discharging superheat is below the predetermined threshold.

In order to more reliably prevent the occurrence of the liquid-back, the closing of the on/off valve is controlled when the obtained discharging superheat exceeds the threshold, and the at least one processor decreases the obtained discharging superheat to a change rate greater than a preset change rate.

In order to prepare an appropriate amount of the refrigerant, a super-cooling degree is obtained based on the temperature of the refrigerant on a discharge side of an outdoor heat exchanger and the pressure of the refrigerant, the amount of the refrigerant is detected based on the obtained super-cooling degree and a target super-cooling degree, and at least one of the opening and closing of the on/off valve is controlled based on the detected amount of the refrigerant when the at least one processor receives the temperature of a discharge side of the refrigerant and the pressure of the refrigerant in the outdoor heat exchanger provided in a refrigerant passage portion by a communication unit.

The target super-cooling degree is determined according to various environments, and the target super-cooling degree is preferably a parameter of at least one of an outdoor temperature, an indoor temperature, or a pipe length.

As a control method of the on/off valve based on the discharging superheat degree, for example, when the discharging superheat degree calculated after the refrigerant charging starts reaches a threshold value, the on/off valve can be opened to further improve the charging speed.

However, in the case of such control, when the responsiveness of control of the on/off valve is not fast, the discharging superheat degree may exceed the threshold value, and there is fear that liquid-back may occur. However, when the control responsiveness of the on/off valve is quick, it becomes expensive as a device.

Therefore, the at least one processor controls an opening time of the on/off valve to be longer than a preset opening time, or controls a closing time of the on/off valve to be shorter than a preset closing time when a difference between the obtained super-cooling degree and the target super-cooling degree is greater than a preset value. With such configuration, a filling rate can be improved to the greatest extent possible despite a low-cost configuration, and the liquid-back can be reliably prevented.

The at least one processor controls the opening time of the on/off valve to be shorter than the preset opening time, or controls the closing time of the on/off valve to be longer than the preset closing time when the difference between the obtained super-cooling degree and the target super-cooling degree is smaller than the preset value.

In such configuration, the desired amount of the refrigerant can be charged in the refrigerant flow path by changing the opening time or the closing time of the on-off valve so that the calculated super-cooling degree approaches the target super-cooling degree.

In a more specific embodiment, the at least one processor controls the opening time of the on/off valve to be shortened or the closing time of the on/off valve to be longer in proportion to the difference between the obtained super-cooling degree and the target super-cooling degree. However, when the refrigerant is charged in a large amount when the outdoor temperature is low, a liquid refrigerant is accumulated in a portion where the liquid refrigerant does not accumulate (for example, a gas piping or accumulator on a compressor suction side) among the refrigerant passage parts. The characteristics of the amount of the refrigerant and the degree of super-cooling in the refrigerant passage portion are collapsed, thereby reducing the accuracy of the refrigerant charging.

Therefore, it is preferable that the lower the outdoor temperature, the shorter the opening time of the on-off valve or the longer the closing time of the on-off valve.

The at least one processor may change the opening time or the closing time of the on/off valve based on the obtained change rate of super-cooling. By controlling the on/off valve according to the rate of change of the super-cooling degree, for example, it is possible to predict the time until the calculated super-cooling degree reaches the target super-cooling degree to some extent, thereby improving the charging accuracy of the refrigerant.

The refrigerant charging device may further include a first refrigerant charging port provided on a liquid pipe side of the refrigerant flow path to fill the refrigerant flow path with the refrigerant when the refrigerant flow path is stopped, and a second refrigerant charging port provided on a gas pipe side of the refrigerant flow path to fill the refrigerant flow path with the refrigerant when the refrigerant flow path is in the cooling operation.

With such configuration, the refrigerant can be charged in each of the liquid pipe and the gas pipe according to the operating state of an air conditioner Z, so that the charging amount can be increased.

For example, in order to switch the refrigerant charging port for charging the refrigerant according to timing, such as before and after the start of the operation of the air conditioner, it is preferable that the refrigerant charging device includes a first refrigerant charging flow path portion for charging the refrigerant in the first refrigerant charging port, and a second refrigerant charging flow path for charging the refrigerant in the second refrigerant charging port.

The first refrigerant charging flow path may have a first on/off valve for controlling a flow of the refrigerant, and the second refrigerant charging flow path may have a second on/off valve for controlling a flow of the refrigerant, and the first on/off valve may have a diameter larger than a diameter of the second on/off valve.

With such configuration, before and after the start of the operation of the air conditioner, the charging amount to be charged using the first refrigerant charging flow path and the second refrigerant charging flow path can be adjusted to an appropriate amount, respectively.

The air conditioner includes a first processor for performing the cooling operation or heating operation, the refrigerant charging flow path is accommodated in a separate case from the air conditioner, and the first processor is accommodated in an outdoor unit of the air conditioner, and the air conditioner and the refrigerant charging device have a communicator to communicate with each other by wire or wirelessly, and it is preferable that the on/off valve is controlled through the communication unit.

In such configuration, since the first processor is accommodated in the outdoor unit, control of the on/off valve can be performed by the first processor that controls the air conditioning operation. Therefore, a dedicated processor for controlling the on/off valve is unnecessary, and equipment can be configured cheaper and simpler.

As a more specific embodiment, the communicator may communicate through the Internet, and the control of the first processor may be, for example, a form in which the control can be changed by information obtained through the communicator.

For example, when the refrigerant is charged from a refrigerant tank as it is, when the charging amount is increased so as to improve the charging speed, the refrigerant on the suction side of the compressor becomes a two-phase gas-liquid, and reliability of the compressor is impaired. Therefore, there is a limit in improving a filling speed when trying to guarantee the reliability of the compressor.

Therefore, it is preferable to provide a depressurizing portion (also referred to as a depressurizing mechanism) for depressurizing the refrigerant charging the refrigerant flow path of the air conditioner.

In such configuration, since the refrigerant in the refrigerant tank can be charged under reduced pressure, the refrigerant on the suction side of the compressor can be gasified more than when the refrigerant in the refrigerant tank is charged as it is, and a further improvement in the charging speed can be achieved without compromising the reliability of the compressor.

As a specific embodiment of the depressurizing portion, an expansion valve provided in the refrigerant charging flow path portion or a capillary tube constituting the refrigerant charging flow path portion can be exemplified.

In addition, a heating unit (also referred to as a heating mechanism) for heating the refrigerant charging the refrigerant flow path may be provided.

Also in this configuration, the suction side refrigerant of the compressor can be used as a gas refrigerant, compared to the case where the refrigerant in the refrigerant tank is charged as it is, and a better improvement of the charging speed can be achieved without compromising the reliability of the compressor.

Specific embodiments of heating means include heat exchange between a heater, the refrigerant flowing through the refrigerant charging flow path, and a high temperature refrigerant flowing through the refrigerant flow path, for example, heat exchange between the refrigerant flowing in the refrigerant charging flow path and the ambient air in the refrigerant charging flow path is exemplified.

In addition, in order to switch the refrigerant charging port for charging the refrigerant according to timing, for example, before and after the start of the operation of the air conditioner, preferably, a circuit for charging the refrigerant flow path with the refrigerant is configured to be switched to the first refrigerant flow path or the second refrigerant flow path.

The refrigerant charging device is preferable to further include the first refrigerant charging flow path, a communication flow path communicating with the second refrigerant charging flow path part, and a filter provided in the communication flow path to remove foreign substances or remove deteriorated refrigerator oil.

With such configuration, by controlling a valve flow so that the refrigerant flows in a communication flow path portion, foreign matter or deteriorated freezer oil can be removed, and as a result, reliability of the air conditioner can be improved.

The invention can provide a highly reliable refrigerant charging device and a refrigerant charging system by improving the charging speed while preventing liquid back and reducing the cost.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
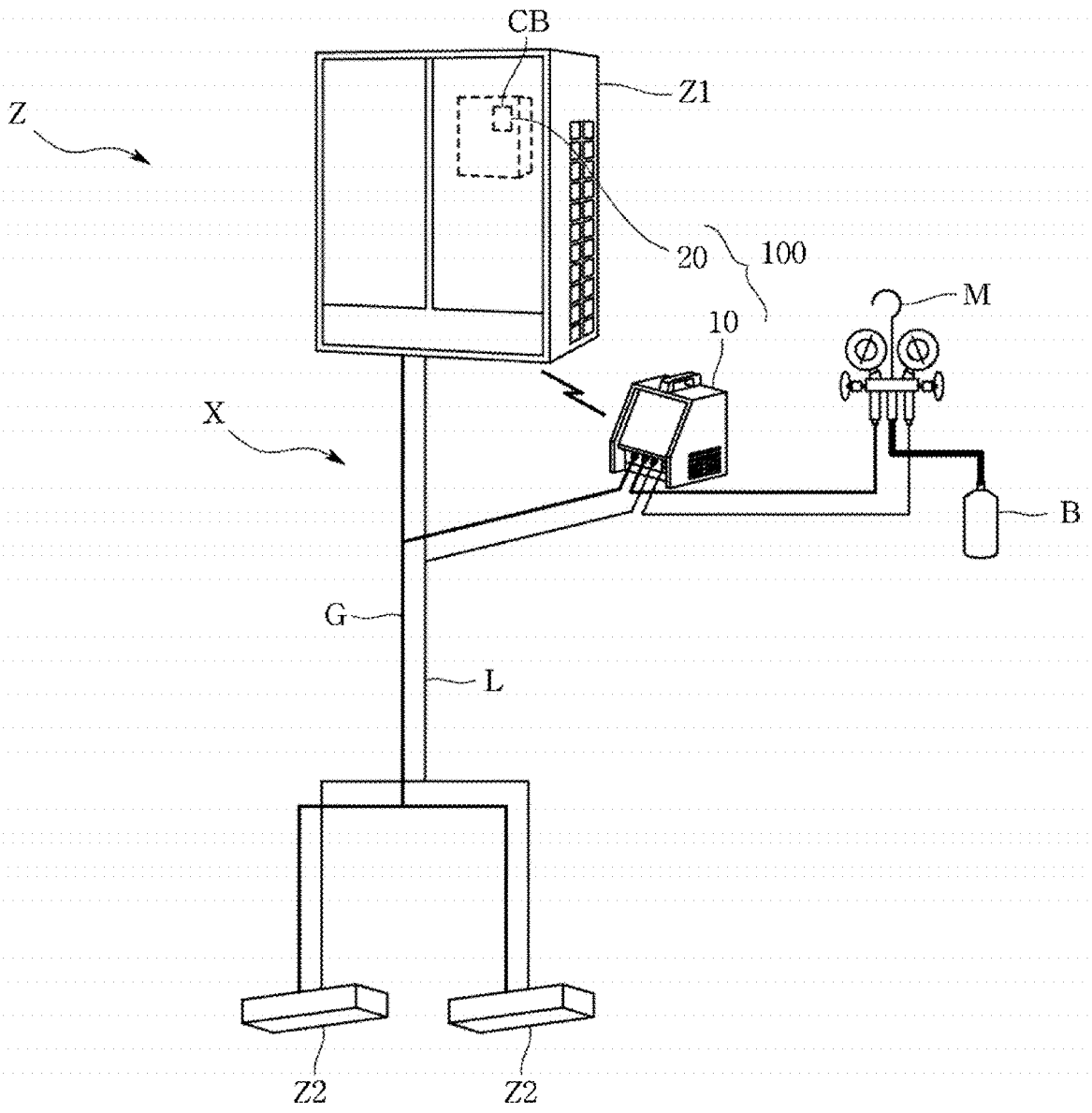
FIG. 1 illustrates a configuration diagram of a refrigerant charging device and an air conditioner in a refrigerant charging system according to an embodiment.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

This specification does not describe all elements of the embodiments of the present disclosure and detailed descriptions on what are well known in the art or redundant descriptions on substantially the same configurations may be omitted.

The term "part," as used herein, may be implemented in software or hardware. According to embodiments, a plurality of 'parts' may be implemented as one component, or one 'part' may include a plurality of components.

Throughout the specification, when an element is referred to as being "connected to" another element, it may be directly or indirectly connected to the other element and the "indirectly connected to" includes being connected to the other element via a wireless communication network.

Also, it is to be understood that the terms "include" and "have" are intended to indicate the existence of elements disclosed in the specification, and are not intended to preclude the possibility that one or more other elements may exist or may be added.

In this specification, terms "first," "second," etc. are used to distinguish one component from other components and, therefore, the components are not limited by the terms.

An expression used in the singular form encompasses the expression of the plural form, unless it has a clearly different meaning in the context.

The reference numerals used in operations are used for descriptive convenience and are not intended to describe the order of operations and the operations may be performed in a different order unless otherwise stated.

Hereinafter, embodiments of the present disclosure will be described in detail with reference to the accompanying drawings.

A refrigerant charging system 100 according to an embodiment, for example, by using a refrigerant stored in a refrigerant charging device for charging the refrigerant in a refrigerant flow path X of an air conditioner Z, as shown in FIG. 1, the refrigerant charging system including a refrigerant tank B that is a source of the refrigerant to be charged, a refrigerant charging device 10 connected between the refrigerant flow path X, and a control device 20 for controlling the refrigerant charging operation by the refrigerant charging device 10.

Here, the air conditioner Z includes an outdoor unit Z1 in which a compressor, an outdoor heat exchanger, and an expansion valve are disposed in a main body, an indoor unit Z2 having an indoor heat exchanger, and the refrigerant flow path X having a liquid pipe L for transporting liquid refrigerant and a gas pipe G for transporting gaseous refrigerant while simultaneously connecting the outdoor unit Z1 and the indoor unit Z2.

Here, a plurality of the indoor units Z2 arranged on an outdoor side and accommodating the indoor heat exchanger may be connected to one of the outdoor units Z1 arranged on the outdoor side to accommodate the outdoor heat exchanger. At this time, a plurality of the outdoor units Z1 may be provided, and the indoor units Z2 connected to the outdoor unit Z1 may be one.

<Refrigerant Charging Device>

First, the refrigerant charging device 10 will be described.

Figure 2:
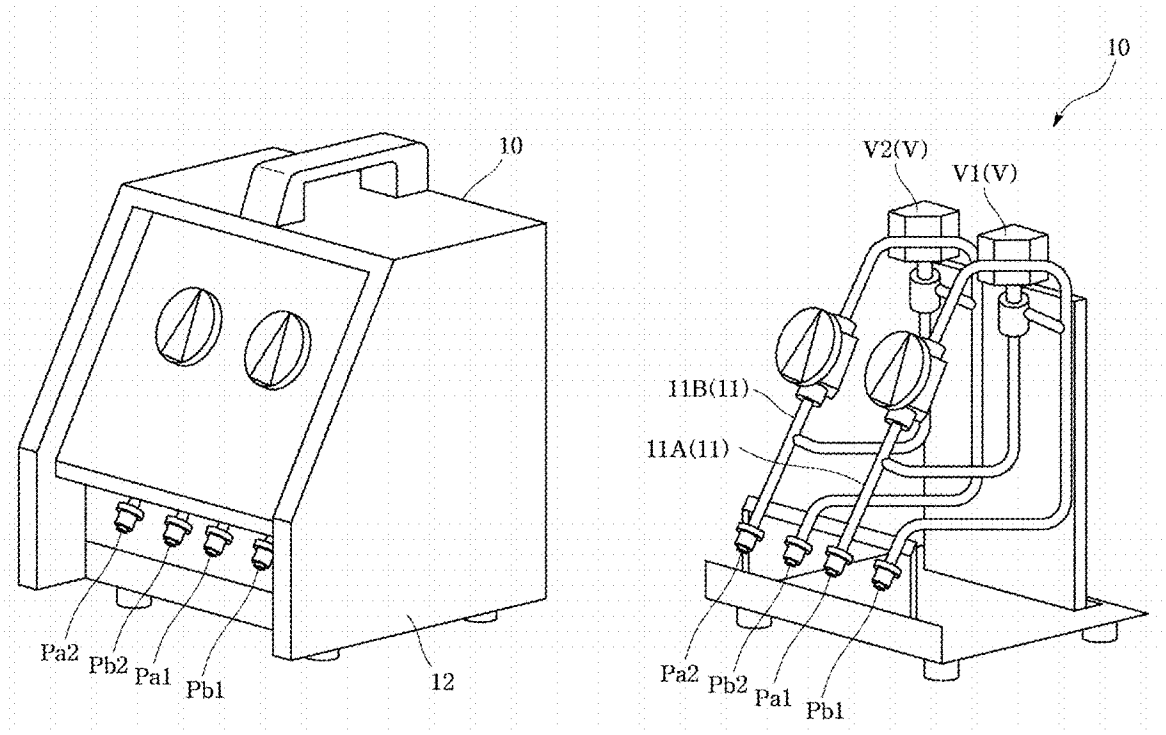
FIG. 2 illustrates a schematic diagram of a refrigerant charging device according to an embodiment.

Referring to FIG. 2, the refrigerant charging device 10 includes a refrigerant charging flow path portion 11A connected to the refrigerant flow path X and a case 12 accommodating the refrigerant charging flow path portion 11A.

The refrigerant charging flow path portion 11A is connected to the refrigerant flow path X, and includes a refrigerant charging port Pa1 for charging the refrigerant in the refrigerant flow path X, an on/off valve V1 such as a solenoid valve for switching refrigerant charging and stop-charging. The on/off valve V1 may allow the refrigerant to be supplied to the refrigerant flow path X through the refrigerant charging port Pa1 or to block the supply of the refrigerant. That is, the on/off valve V1 may control the refrigerant supplied to the refrigerant flow path X.

Here, the refrigerant charging flow path portion 11A is connected to the refrigerant flow path X, and at the same time, a refrigerant charging port Pb1 is connected to, for example, a manifold gauge M to the refrigerant tank B, which is a source of the refrigerant to be charged.

The refrigerant charging port Pa1 of the refrigerant charging flow path portion 11A may be connected to the liquid pipe L connecting the outdoor unit Z1 and the indoor unit Z2, as shown in FIG. 1. That is, the refrigerant charging port Pa1 can be connected to the liquid pipe L through a charging hose.

In addition, as shown in FIGS. 1 and 2 of this embodiment, apart from the above refrigerant charging flow path portion 11A (hereinafter also referred to as 'first refrigerant charging flow path portion 11A'), the refrigerant charging device 10 may further include a second refrigerant charging flow path portion 11B having a refrigerant charging port Pa2 connected to the gas pipe G connecting the outdoor unit Z1 and the indoor unit Z2. This refrigerant charging port Pa2 can be connected to the gas pipe G through a charging hose.

Like the first refrigerant charging flow path portion 11A, the second refrigerant charging flow path portion 11B has a refrigerant suction port Pb2 and an on/off valve V2. Here, the on/off valve V2 may allow the refrigerant to be supplied to the refrigerant flow path X through the refrigerant charging port Pa2 or block the supply of the refrigerant. That is, the on/off valve V2 can control the refrigerant supplied to the refrigerant flow path X.

Here, the second refrigerant charging flow path portion 11B may be composed of a pipe different from the first refrigerant charging flow path portion 11A. In addition, the diameter of the on/off valve V2 provided in the second refrigerant charging flow path portion 11B may be smaller than the diameter of the on/off valve V1 of the first refrigerant charging flow path portion 11A. That is, the refrigerant charging port Pa2 of the second refrigerant charging flow path portion 11B may be different from the refrigerant charging port Pa1 of the first refrigerant charging flow path portion 11A. A portion of piping constituting the second refrigerant charging flow path portion 11B may be shared with a portion of piping constituting the first refrigerant charging flow path portion 11A.

Hereinafter, when the first refrigerant charging flow path portion 11A and the second refrigerant charging flow path portion 11B are not explicitly distinguished, as an high-level concept including the first refrigerant charging flow path portion 11A or the second refrigerant charging flow path portion 11B, it is described as a refrigerant charging flow path portion 11. Similarly, it is described as an on/off valve V as a high-level concept including the on/off valve V1 or the on/off valve V2.

The case 12 is a body different from the outdoor unit of the air conditioner Z, and specifically, may be provided as a body different from an electric unit box CB (see FIG. 1) of the outdoor unit Z1. Here, the case 12 may be provided as a portable type having a gripping portion. Pipes constituting the first refrigerant charging flow path portion 11A or the second refrigerant charging flow path portion 11B penetrating the outer wall of the case 12 may be provided. That is, the first refrigerant charging flow path portion 11A or the second refrigerant charging flow path portion 11B may be exposed outside the case 12. Due to this, each port may be located outside the case 12.

<Control Device>

Next, the control device 20 will be described.

The control device 20 controls the refrigerant charging operation by the refrigerant charging flow path portion 11.

Figure 3A:
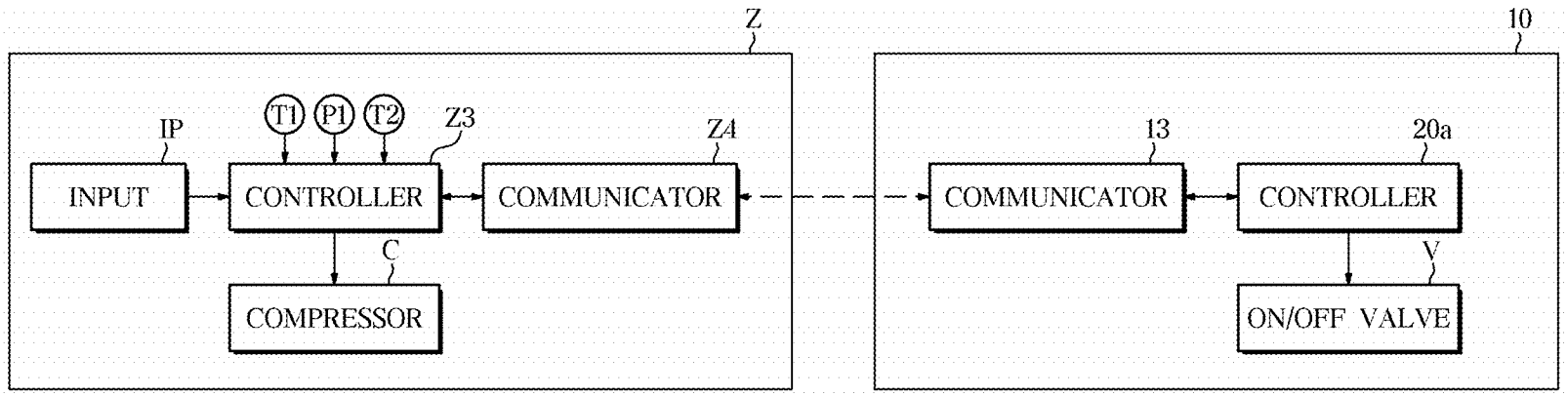
FIG. 3A illustrates an example of a block diagram of an air conditioner and a refrigerant charging device according to an embodiment.

As shown in FIG. 3A, the control device 20 may be provided in the case 12 of the refrigerant charging device 10. The control device 20 may be provided separately from the electric unit box CB of the outdoor unit Z1. That is, the control device 20 can perform a function as a controller 20*a* that controls the operation of the refrigerant charging flow path portion 11.

More specifically, the refrigerant charging device 10 includes a communicator 13 that communicates with the air conditioner Z, and the control device 20 that functions as the controller 20*a* that controls opening and closing of the on/off valve V based on various information of the air conditioner Z received through the communicator 13. Here, various information of the air conditioner Z may include at least one of information detected by a first temperature sensor T1, a first pressure sensor P1, and a second temperature sensor T2.

The communicator 13 may perform at least one of wired communication and wireless communication, and may communicate through the Internet.

That is, when the controller 20*a* receives at least one of the information detected by the first temperature sensor T1, the first pressure sensor P1, and the second temperature sensor T2 in response to the setting of an automatic charging mode, the refrigerant stored in the refrigerant tank B is supplied to the air conditioner Z by controlling the opening and closing of the on/off valve V based on the received at least one information.

In this case, the air conditioner Z has an input IP for receiving an automatic charging mode setting command as a user input, a controller Z3 controlling the operation of a compressor C and a four-way valve during the cooling or heating operation when the setting command of the automatic charging mode is received by the input IP and various information of the air conditioner Z is transmitted to the refrigerant charging device 10, and a communicator Z4 that transmits various information of the air conditioner Z to the refrigerant charging device 10 in response to the control command of the controller Z3.

Here, the communicator Z4 may perform at least one of wired communication and wireless communication. The communicator Z4 can communicate through the Internet.

The controller Z3 is a memory that stores data for an algorithm or program that reproduces the algorithm for controlling the operation of the components in the air conditioner Z, and a processor that performs the above-described operation using the data stored in the memory. At this time, the memory and the processor may be implemented as separate chips, respectively. Alternatively, the memory and the processor may be implemented as a single chip.

Figure 3B:
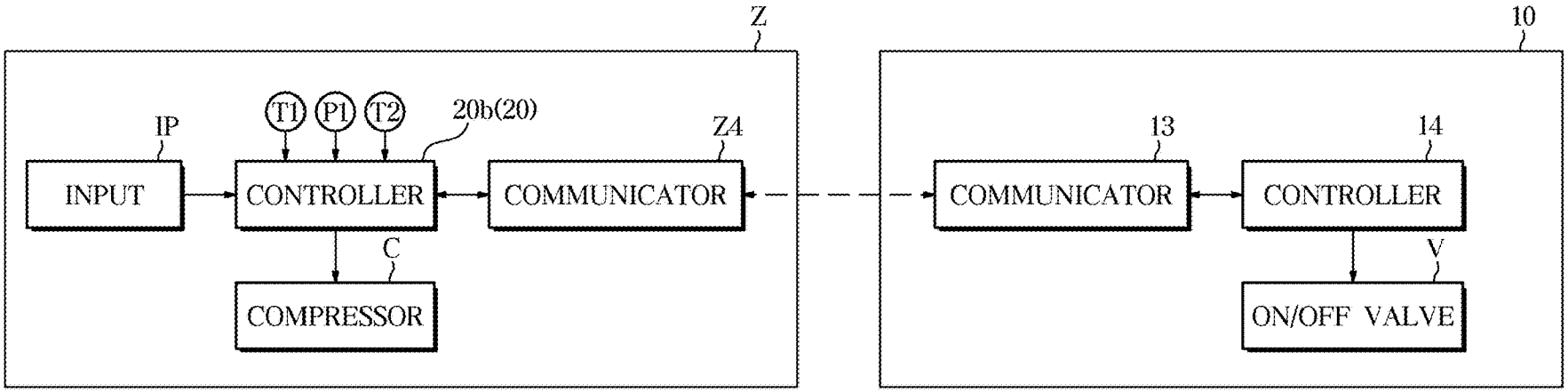
FIG. 3B illustrates another example of a block diagram of an air conditioner and a refrigerant charging device according to an embodiment.

The controller 20*a* may be implemented by a memory storing data for an algorithm-reproducing program for controlling the operation of the components in the refrigerant charging device 10 and a processor performing the above-described operation using the data stored in the memory. At this time, the memory and the processor may be implemented as separate chips, respectively. Alternatively, the memory and the processor may be implemented as a single chip. As shown in FIG. 3B, the control device 20 may be provided in the air conditioner Z. More specifically, the control device 20 may be provided in the outdoor unit Z1 of the air conditioner Z. The control device 20 is housed in the electric unit box CB of the outdoor unit Z1, and functions as a controller for controlling compressors, four-way valves, etc., contained in the same electric unit box CB. That is, a controller 20*b* that controls the operation of the air conditioner Z can also function to control the operation of the refrigerant charging flow path portion 11.

More specifically, the air conditioner Z includes the input IP for receiving the setting command of the automatic charging mode as the user input, a controller for controlling the operation of the compressor C and the four-way valve during the cooling operation or heating operation, and controlling the opening and closing of the on-off valve V based on various information of the air conditioner Z when a setting command for the automatic charging mode is received by the input IP and the communicator Z4 that transmits an opening/closing command of the on/off valve V to the refrigerant charging device 10 in response to the control command of the controller 20*b*.

Here, the communicator Z4 can perform at least one of wired communication and wireless communication, and can communicate through the Internet. Various types of information of the air conditioner Z may include the at least one of information detected by the first temperature sensor T1, the first pressure sensor P1, and the second temperature sensor T2.

In this case, the refrigerant charging device 10 includes the communicator 13, which communicates with the air conditioner Z, and the controller 14 configured to open or close the on/off valve V in response to the received opening or closing command when the opening command or closing command of the on/off valve V is received through the communicator 13. The communicator 13 may perform at least one of wired communication and wireless communication, and may communicate through the Internet.

The communicator 13 can perform at least one of wired communication and wireless communication, and can communicate through the Internet.

Figure 3C:
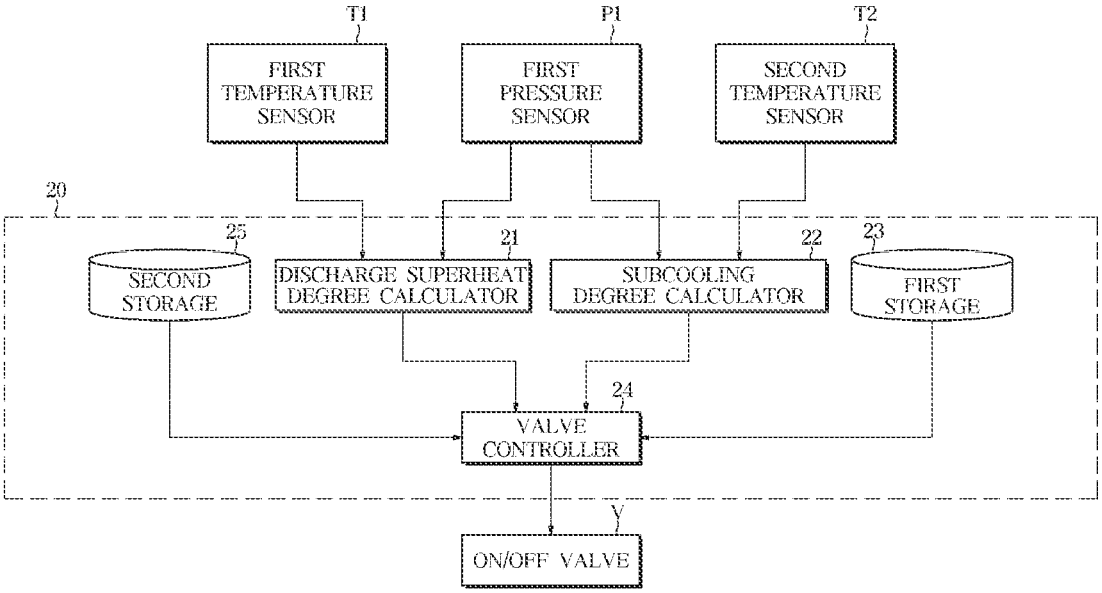
FIG. 3C illustrates a functional block diagram showing a controller function of one of an air conditioner and a refrigerant charging device according to an embodiment.

That is, the controller 14 controls the operation of the on/off valve V in response to the setting of the automatic charging mode and the opening and closing commands of the on/off valve V, so that the refrigerant stored in the refrigerant tank B is supplied to the air conditioner Z. Specifically, the control device 20: 20*a* or 20*b* is provided with a microcomputer or memory, as shown in FIG. 3C, and includes a discharging superheat degree calculator 21, a super-cooling degree calculator 22, a first storage 23 (also referred to as 'super-cooling degree storage'), and a valve controller 24.

The controller 20*b* may be implemented by a memory that stores data for an algorithm or a program that reproduces the algorithm for controlling the operation of components in the air conditioner Z, and a processor that performs the above-described operation using the data stored in the memory. At this time, the memory and the processor may be implemented as separate chips, respectively. Alternatively, the memory and the processor may be implemented as a single chip.

The controller 14 may be implemented by a memory storing data for an algorithm-reproducing program for controlling the operation of the components in the refrigerant charging device 10 and a processor performing the above-described operation using the data stored in the memory. At this time, the memory and the processor may be implemented as separate chips, respectively. Alternatively, the memory and the processor may be implemented as a single chip.

Meanwhile, each component illustrated in FIGS. 3A and 3B refers to hardware components such as software and/or field programmable gate arrays (FPGAs) and application specific integrated circuits (ASICs).

Hereinafter, each part of the control device 20: 20*a* or 20*b* will be described.

The discharging superheat degree calculator 21 calculates a discharging superheat degree, which is the superheat degree of the refrigerant discharged from the compressor. The discharging superheat degree is the difference between the temperature of the gas refrigerant discharged from the compressor and the saturation temperature in the pressure of the gas refrigerant.

The control device can obtain the discharging superheat degree by calculating the discharging superheat degree which is the superheat degree of the refrigerant discharged from the compressor.

Figure 4:
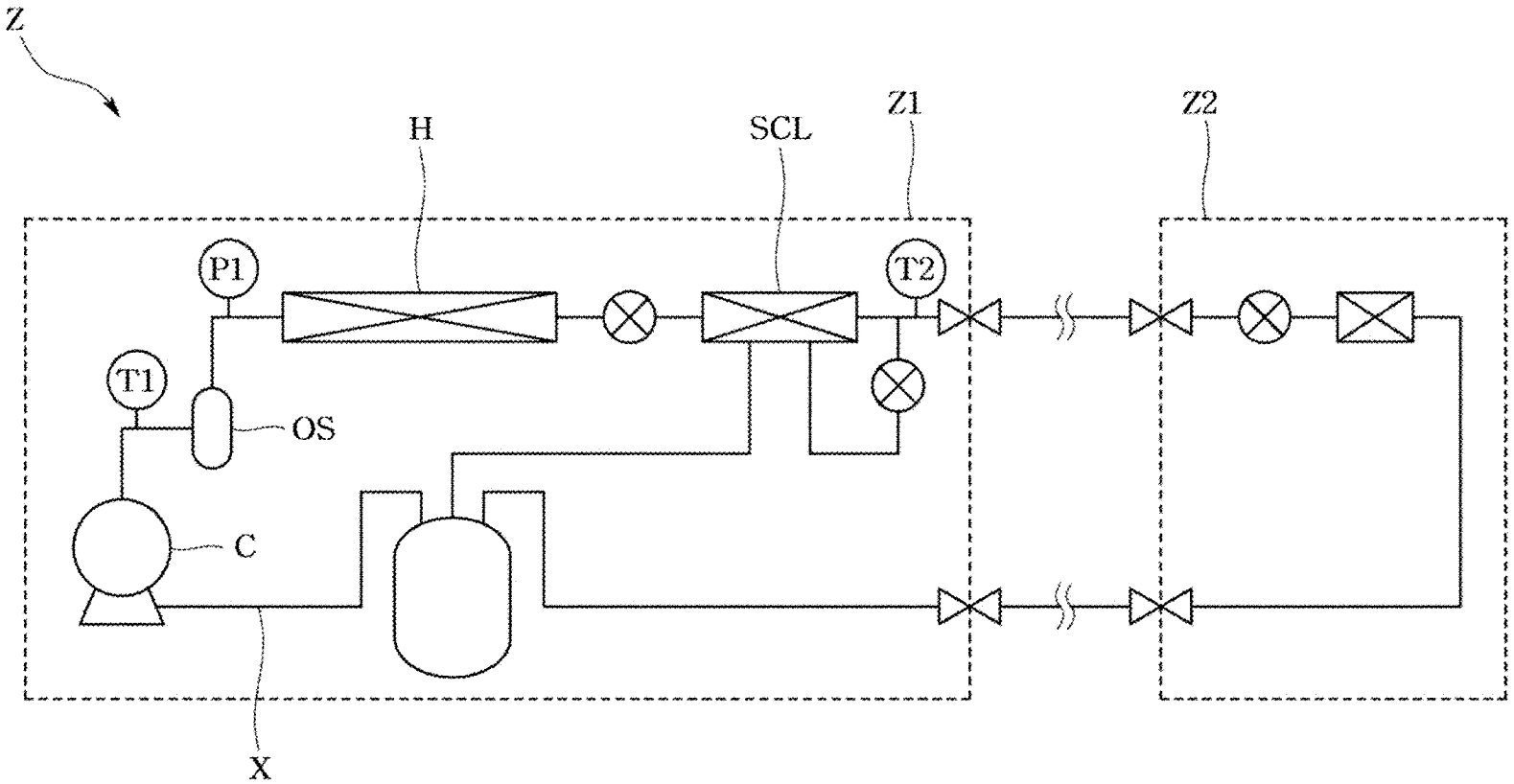
FIG. 4 illustrates a schematic diagram showing an arrangement of a pressure sensor and a temperature sensor provided in an air conditioner according to an embodiment.

As shown in FIG. 4, the first temperature sensor T1 and the first pressure sensor P1 may be provided downstream of the compressor C in the refrigerant flow path X of the air conditioner. Specifically, the first temperature sensor T1 may be provided between the compressor C and an oil separator OS, and the first pressure sensor P1 may be provided between the oil separator OS and an outdoor heat exchanger H. Therefore, the discharging superheat degree calculator 21 may calculate the discharging superheat degree based on the refrigerant temperature detected by the first temperature sensor T1 and the refrigerant pressure detected by the first pressure sensor P1.

The super-cooling degree calculator 22 calculates the super-cooling degree based on the temperature and pressure of the refrigerant passing through the outdoor heat exchanger H. This super-cooling degree is the difference between the temperature of the liquid refrigerant after passing through the outdoor heat exchanger H as a condenser and the saturation temperature at the pressure of the liquid refrigerant, and the higher the refrigerant charge, the higher the temperature. Since the pressure loss of the refrigerant in the outdoor heat exchanger H is small, the pressure of the liquid refrigerant before entering the outdoor heat exchanger H and the pressure of the liquid refrigerant after passing through the outdoor heat exchanger H are considered as the same.

That is, the control device may obtain the super-cooling degree by calculating the super-cooling degree based on the temperature and pressure of the refrigerant passing through the outdoor heat exchanger H.

In this embodiment, as shown in FIG. 4, an auxiliary cooler SCL may be provided downstream of the outdoor heat exchanger H, and the second temperature sensor T2 may be provided downstream of the outdoor heat exchanger H. Therefore, the super-cooling degree calculator 22 can calculate the super-cooling degree based on the refrigerant temperature detected by the second temperature sensor T2 and the refrigerant pressure detected by the first pressure sensor P1.

That is, the control device may obtain the super-cooling degree by calculating the super-cooling degree based on the refrigerant temperature detected by the second temperature sensor T2, and the refrigerant pressure detected by the first pressure sensor P1.

The first storage 23 may store the correlation data between a target value of the super-cooling degree (hereinafter referred to as 'calculated super-cooling degree') calculated by the super-cooling degree calculator 22 (hereinafter referred to as 'target super-cooling degree') and at least one of an outdoor temperature, an indoor temperature, or a pipe length.

Specifically, the correlation data is for determining the target super-cooling degree by using at least one of the outdoor temperature, the indoor temperature, or the pipe length as a parameter, and may be, for example, a lookup table or a calculation formula. In addition, the first storage 23 may store a value of the target super-cooling degree set in advance.

The valve controller 24 controls the on/off valve V of the refrigerant charging flow path portion 11. Specifically, the valve controller 24 selectively controls the opening/closing valve V to either an open state or a closed state of the opening degree so that the calculated super-cooling degree calculated by the super-cooling degree calculator 22 approaches the target super-cooling degree. In addition, the valve controller 24 may function as a refrigerant amount sensing unit that detects the amount of the refrigerant from the difference between the calculated super-cooling degree and the target super-cooling degree, and may control the on-off valve V based on the detected refrigerant amount.

Therefore, the valve controller 24 of this embodiment uses the discharging superheat degree calculated by the discharging superheat degree calculator 21 to control the opening/closing valve V, specifically, the opening/closing valve V may be controlled by comparing a preset threshold with a lower limit value of the discharging superheat degree and the calculated discharging superheat degree. A threshold value may be stored in a second storage 25 (also referred to as 'threshold storage'), and may be a value of the discharging superheat degree that prevents liquid-back from being generated by the compressor.

Figure 5:
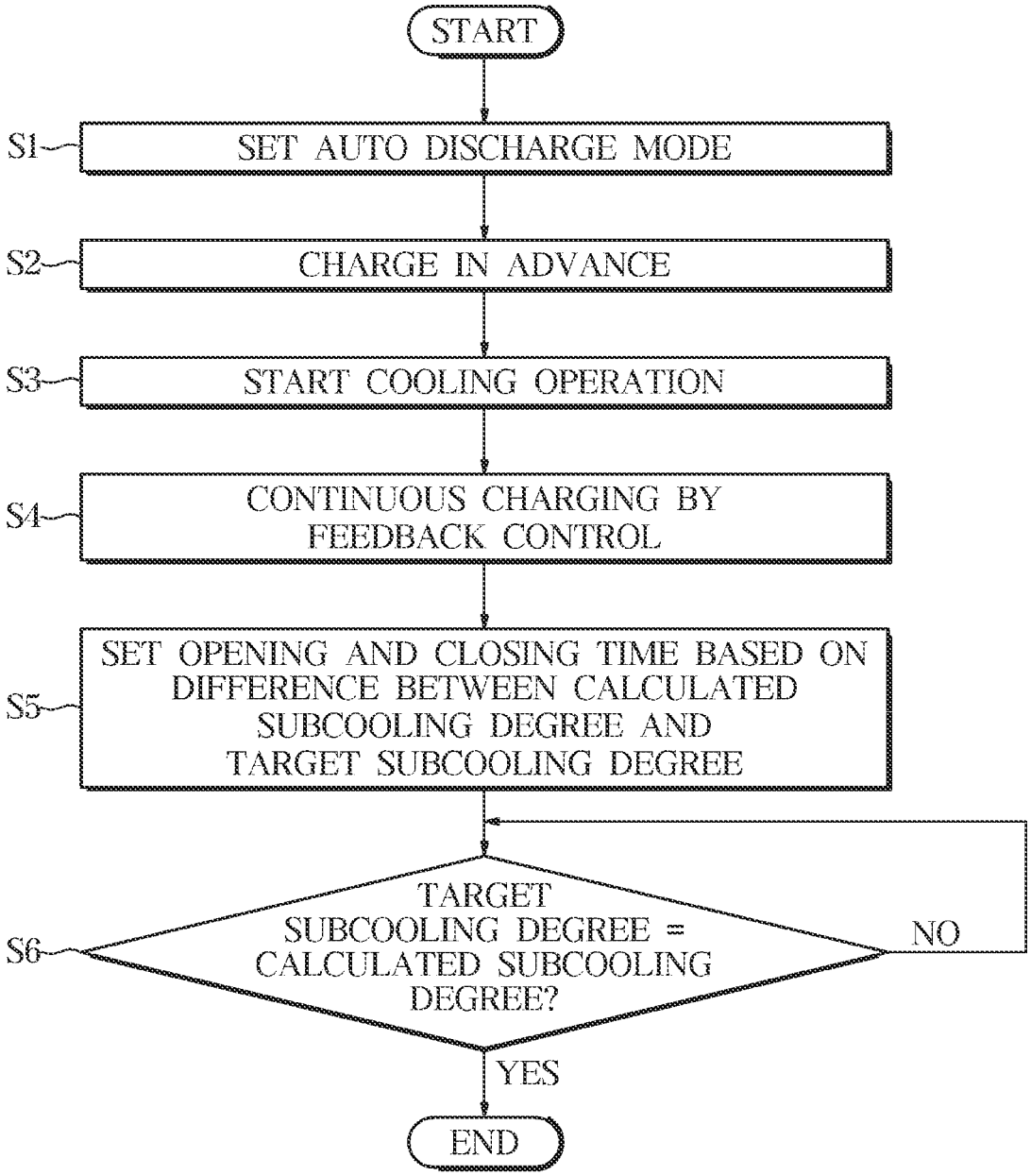
FIG. 5 illustrates a flowchart showing control of a control mechanism of a refrigerant charging device according to an embodiment.

The operation of charging the refrigerant in the refrigerant flow path X of the air conditioner Z using the refrigerant charging device 10 configured as described above will be described with reference to the flowchart of FIG. 5.

First, a contractor sets the control device 20 accommodated in the outdoor unit to the automatic charging mode (S1). As described above, when the charging mode is set to the automatic charging mode by the contractor, the refrigerant charging device 10 may enter the automatic charging mode in response to the setting of the automatic charging mode.

Thereafter, the refrigerant charging device 10 opens and closes the on/off valve V1 for a predetermined time before the operation of the air conditioner Z, thereby performing pre-charging for sealing the refrigerant in the liquid pipe L for the predetermined time (S2).

Subsequently, the contractor manually opens a service valve on the gas pipe G side of the outdoor unit Z1 and a service valve on the oil pipe L side manually. Due to this, the service valve on the gas pipe G side of the outdoor unit Z1 of the air conditioner and the service valve on the oil pipe L are both opened. Then, the air conditioner Z starts the cooling operation (S3). Here, the service valve may be in an open state when filling the gas pipe G and the liquid pipe L with the refrigerant, and may be closed when stopping the charging. The state of the service valve may be switched by charging or not.

The air conditioner Z starts charging by feedback control when the cooling operation is stabilized. Specifically, the air conditioner Z repeatedly controls the opening and closing of the on/off valve V2 (S4).

The air conditioner Z changes the opening/closing time of the on/off valve V2 based on the difference between the calculated super-cooling degree and the target super-cooling degree (S5).

Thereafter, the air conditioner Z checks whether the calculated super-cooling degree and the target super-cooling degree match (S6), and when it is determined, the charging operation ends.

The operation after the feedback control will be described in detail.

First, when the feedback control starts, the valve controller 24 of the air conditioner Z controls the opening and closing of the on/off valve V2 of the second refrigerant charging flow path portion 11B, but repeatedly controls the opening and closing at a predetermined time interval. At this time, the valve controller 24 closes and controls the on/off valve V1 of the first refrigerant charging flow path portion 11A. That is, the on/off valve V1 of the first refrigerant charging flow path portion 11A is closed.

Figure 6:
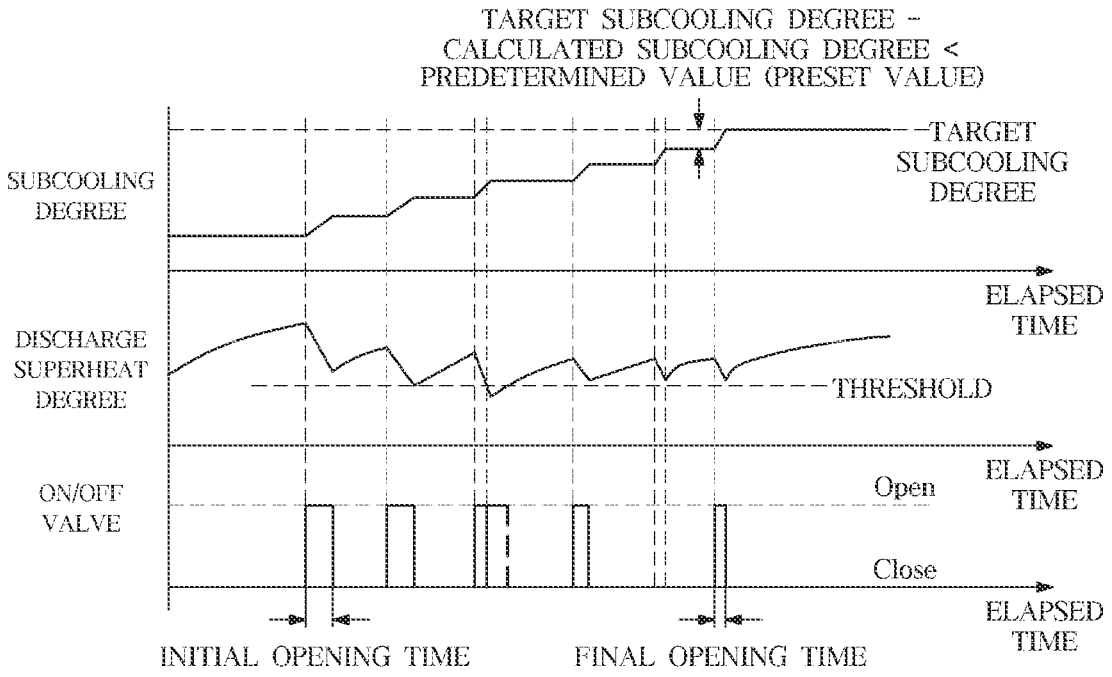
FIG. 6 illustrates a graph showing control contents of a controller of a refrigerant charging device according to an embodiment.

As shown in FIG. 6, when the difference between the calculated super-cooling and the target super-cooling is greater than a preset value, the valve controller 24 of the air conditioner Z controls the opening and closing alternately for a predetermined opening time (hereinafter referred to as 'initial opening time') and a predetermined closing time (hereinafter referred to as 'initial closing time'). At this time, when the on/off valve V2 is in the open state, the discharging superheat degree decreases by charging the refrigerant, and when the on/off valve V2 is closed, the discharging superheat degree increases by stopping the filling of the refrigerant. Here, the initial opening time and the initial closing time may be a preset opening time or a preset closing time.

In addition, the lower limit value of the discharging superheat may be set in advance as the threshold value. As shown in FIG. 6, when the discharging superheat calculated by the discharging superheat degree calculator 21 is below the threshold value, the valve controller 24 can control the on/off valve V2 to be closed regardless of the initial opening time and the initial closing time or the predetermined time interval.

The valve controller 24 may control the closing of the on/off valve V2 when the discharging superheat is not below the threshold value and the discharging superheat is reduced to a change rate greater than a preset change rate. The preset rate of change may be a preset threshold.

In addition, the valve controller 24 can control the on/off valve V2 by comparing the calculated super-cooling degree with the target super-cooling degree. Specifically, when the difference between the calculated super-cooling degree and the target super-cooling degree is equal to or less than a predetermined value, the valve controller 24 may change the opening time of the on/off valve V2 to a final opening time shorter than the initial opening time. Here, the predetermined value may be a value that has been previously set and stored.

At this time, the valve controller 24 may shorten the opening time or extend the closing time in proportion to the difference between the calculated super-cooling degree and the target super-cooling degree.

In this embodiment, although one predetermined value is compared with the difference between the calculated super-cooling degree and the target super-cooling degree, a plurality of predetermined values may be set in stages, and the end opening time may be changed stepwise, such as a first end opening time shorter than the initial opening time and a second end opening time shorter than the first end opening time. Further, the closing time in a final operating mode may not be changed from the initial closing time, or may be longer or shorter than the initial closing time.

Then, the valve controller 24 determines whether the difference between the calculated super-cooling degree and the target super-cooling degree is within a predetermined allowable range. When the difference between the calculated super-cooling degree and the target super-cooling degree is within the predetermined allowable range, the on/off valve V2 is kept closed and controlled. Therefore, the refrigerant charging operation ends.

According to the refrigerant charging device 10 configured as described above, since the on/off valve V2 is controlled based on the discharging superheat, when the discharging superheat degree can be secured high, the on/off valve V2 is left open and the refrigerant is charged, for example, charging can be continued for a certain period of time to improve a charging speed.

On the other hand, when the discharging superheat degree falls below a predetermined threshold within this predetermined time, the on/off valve V2 is closed and the refrigerant filling is stopped, so that the occurrence of liquid-back can be prevented.

As described above, according to the refrigerant charging device 10 according to the present embodiment, despite the inexpensive configuration using the on/off valve V2, it is possible to improve the charging speed as well as to prevent the recovery of the liquid to secure reliability.

Here, when the on/off valve V2 is opened and the control responsiveness of the on/off valve V2 is not fast until the discharging superheat reaches the threshold value after the refrigerant filling starts, there is a fear that liquid-back may occur. In order to increase the control responsiveness of the on/off valve V2, the manufacturing cost of the device increases.

In contrast, the valve controller 24 in the present embodiment repeatedly controls the opening and closing of the valve at the predetermined time interval in a section where the super-cooling degree is smaller than the target super-cooling degree after the refrigerant charging starts. After that, when the discharging superheat is below the threshold, the on/off valve V2 is closed and controlled regardless of the predetermined time interval.

This makes it possible to improve a filling speed as much as possible while constructing the device inexpensively, and furthermore, to reliably prevent liquid-back.

In addition, because the valve controller 24 controls the on/off valve V2 so that the output super-cooling degree approaches the target super-cooling degree, the refrigerant can be filled while the desired amount of the refrigerant flows in the refrigerant flow path X.

In addition, since the target super-cooling degree is determined as at least one of the outdoor temperature, the indoor temperature, or the pipe length as a parameter, an appropriate target super-cooling degree can therefore be set based on an appropriate refrigerant amount according to various environments.

Since the control device 20 is accommodated in the outdoor unit Z1, and the controller controlling the compressor, etc. is in charge of controlling the on/off valves V1 and V2, a dedicated controller for controlling the on/off valves V1 and V2 is unnecessary, so that the equipment can be configured cheaper and simpler.

Here, the present invention is not limited to the above embodiment.

For example, only one of the first refrigerant charging flow path portion 11A and the second refrigerant charging flow path portion 11B may be used.

Further, as the air conditioner Z, a storage unit for storing installation conditions includes the pipe length or the number of indoor units. The refrigerant charging device 10 may be configured to open the on/off valve V1 for a predetermined charging time before the operation when charging the refrigerant in the first refrigerant charging port Pa2. In addition, the charging time before the operation may vary depending on the information of the storage unit and the outdoor temperature.

Hereinafter, a refrigerant charging device according to another embodiment of the present invention will be described with reference to the drawings.

Figure 7:
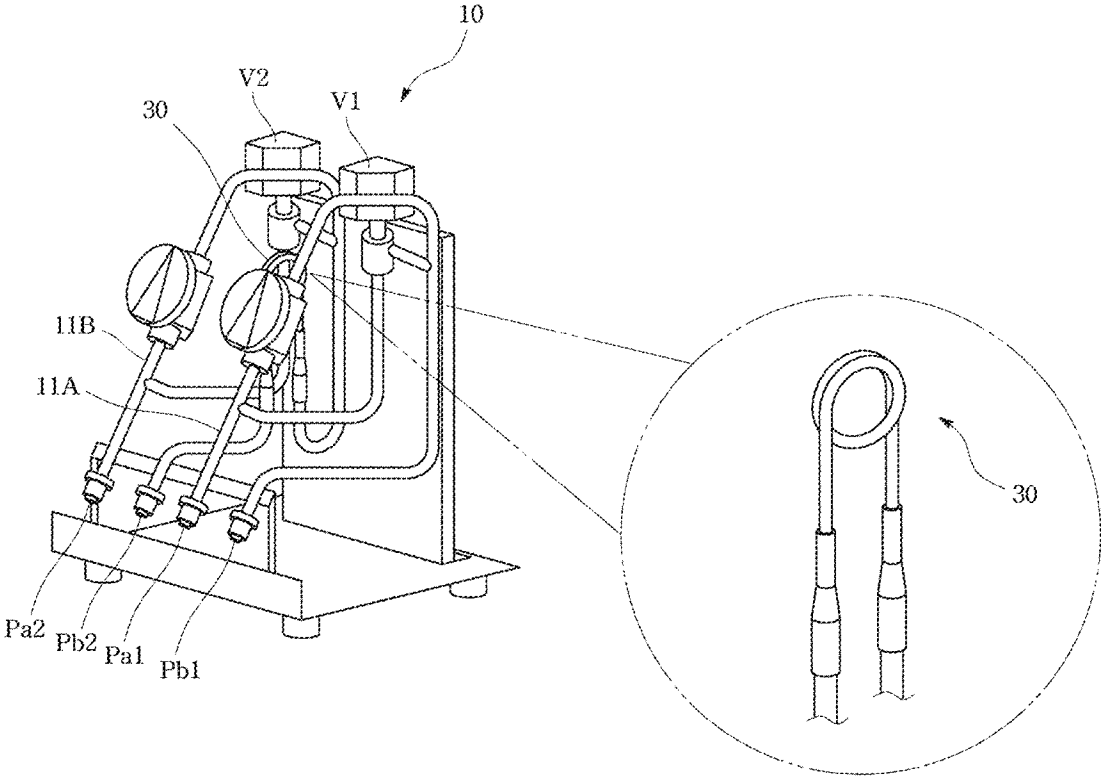
FIG. 7 illustrates a schematic diagram of a refrigerant charging device according to another embodiment.

As illustrated in FIG. 7, the refrigerant charging device 10 may include a decompressor 30 for depressurizing the refrigerant filling the refrigerant flow path X.

Here, the decompressor 30 is a capillary tube constituting a part of the refrigerant charging flow path portion 11, but for example, an expansion valve provided in the refrigerant charging flow path portion 11 can also be used as the decompressor 30.

Figure 8:
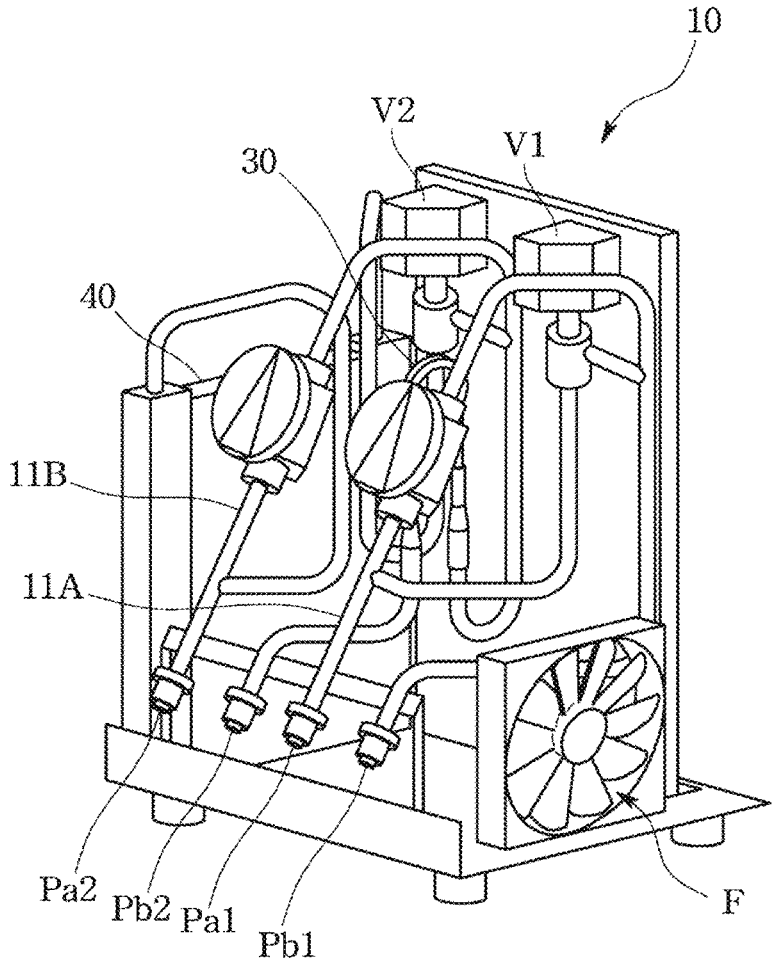
FIG. 8 illustrates a schematic diagram of a refrigerant charging device according to another embodiment.

In addition, as shown in FIG. 8, the refrigerant charging device 10 may include a heater 40 that heats the refrigerant charged in the refrigerant flow path X.

Here, the heater 40 can exchange heat between the refrigerant flowing through the refrigerant charging flow path portion 11 and the ambient air in the refrigerant charging flow path portion 11.

Specifically, the heater 40 may be a heat exchanger through which the decompressor 30 decompresses the refrigerant and then the decompressed refrigerant flows. The refrigerant that has been reduced in pressure and has reached a low temperature flows through the heater 40. Due to this, the heater 40 can exchange heat with the air around the refrigerant charging flow path portion 11. The heater 40 may further include a fan F to blow in the heat exchanger, it is possible to improve the heat exchange efficiency by blowing.

M addition, the heater 40 may exchange heat between, for example, the refrigerant flowing through the refrigerant charging flow path portion 11 and a high temperature refrigerant flowing through the refrigerant flow path X. The heater 40 may be a heater that heats the refrigerant flowing through the refrigerant charging flow path portion 11. With this configuration, it is not necessary to provide the decompressor 30.

Figure 9:
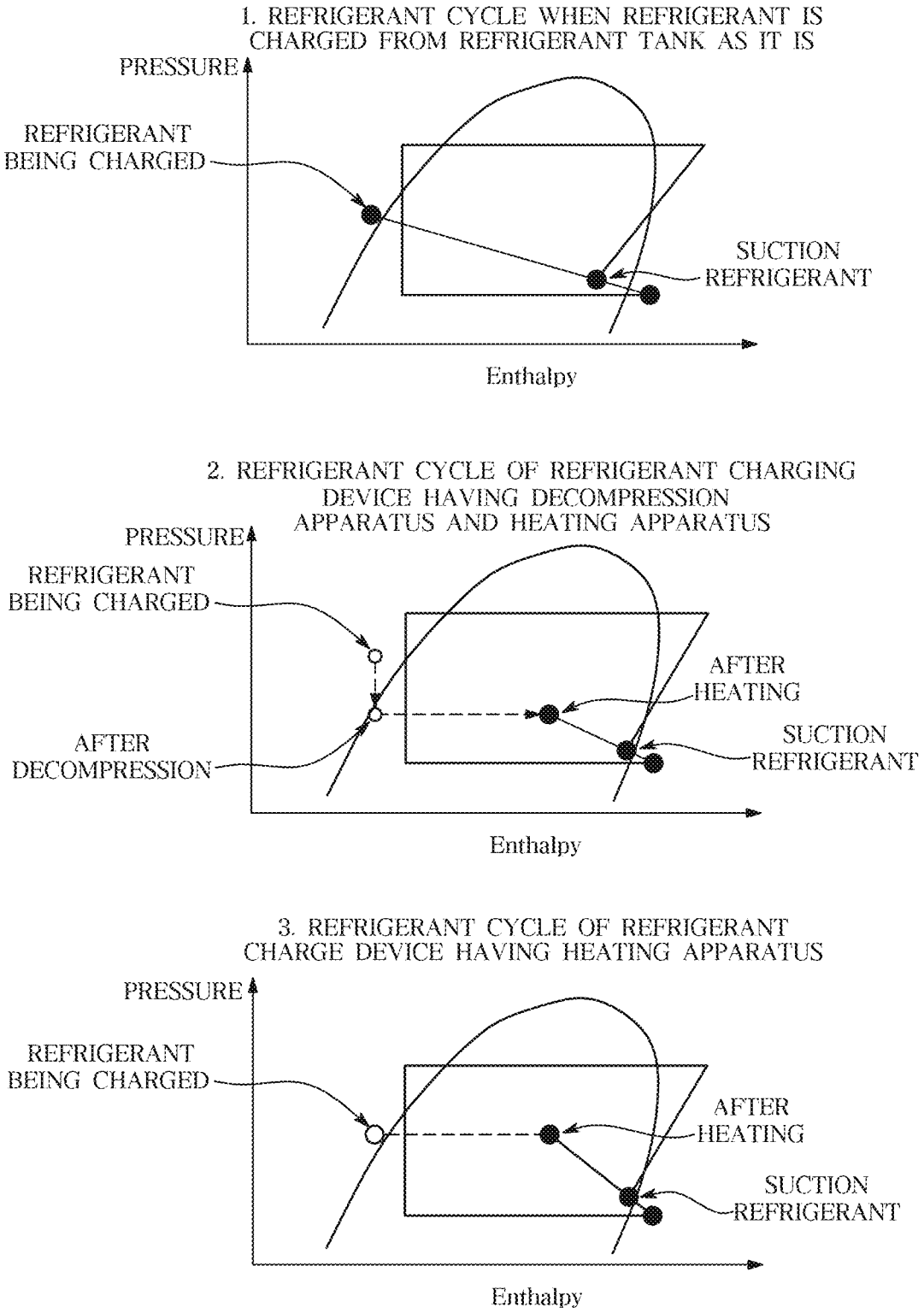
FIG. 9 illustrates a Mollier diagram for explaining the operation of a refrigerant charging device according to another embodiment.

By providing the decompressor 30 or the heater 40 to charge and cool the refrigerant in the refrigerant tank B by depressurizing and/or heating the refrigerant as shown in FIGS. 7 and 8, the refrigerant on the suction side of the compressor can be gasified more than when the refrigerant in the refrigerant tank B is charged as it is as shown in FIG. 9, and thus it is possible to further improve the charging speed without compromising the reliability of the compressor.

On the other hand, when a large amount of the refrigerant is charged when the outdoor temperature is low, the liquid refrigerant accumulates in the portion where the liquid refrigerant does not accumulate (e.g., gas piping and accumulator on the compressor suction side) in the refrigerant flow path X. Refrigerant charging precision may deteriorate due to the collapse of the refrigerant flow path X and the characteristics of the super-cooling degree.

Therefore, the valve controller 24 can acquire the outdoor temperature and change the opening time or the closing time of the on/off valve V based on these outdoor temperatures.

Specifically, the valve controller 24 may shorten the opening time of the on/off valve V or increase the closing time of the on-off valve V as the outdoor temperature is lower.

The valve controller 24 may shorten the opening time of the on/off valve V or control the closing time of the on/off valve V based on the difference between the preset reference outdoor temperature and the obtained outdoor temperature.

The valve controller 24 is configured to control the on/off valve V by comparing the calculated discharging superheat and threshold. When the calculated discharging superheat is not below the threshold value, that is, even when the calculated discharging superheat exceeds the threshold, the on-off valve V may be controlled based on the rate of change (decrease) of the calculated discharging superheat Specifically, the valve controller 24 may shorten the development time of the on/off valve V or control the closing time of the on/off valve V when the reduction rate of the discharging superheat is greater than the predetermined threshold.

Further, the valve controller 24 controls the on/off valve V based on the difference between the calculated super-cooling degree and the target super-cooling degree, but the on/off valve V can also be controlled based on the rate of change (increase rate) of the calculated super-cooling degree.

Specifically, the valve controller 24 may shorten the opening time of the on-off valve V or control the closing time of the on-off valve V when the absolute value of the increase rate of the discharging superheat is greater than a predetermined value.

In addition, although the discharging superheat degree calculator 21 calculates the discharging superheat degree, in addition to the discharging superheat degree or in addition to the discharging superheat degree, it is also possible to calculate the superheat degree of the refrigerant sucked into the compressor.

In this case, the valve controller 24 may control to close the on/off valve V when the calculated superheat is less than or equal to the predetermined threshold.

Furthermore, the refrigerant charging device 10A further includes a communication flow path portion communicating with the first refrigerant charging flow path portion 11A and the second refrigerant charging flow path portion 11B, a filter for removing foreign matter or removing deteriorated freezer oil, which is provided in the communication flow path portion, and a communication opening and closing valve for opening and closing the communication channel is provided in the communication channel.

In this case, the valve controller 24 may control the opening/closing valve for communication so that the refrigerant flows in the communication flow path, thereby removing foreign matter or deteriorated refrigeration oil, and as a result, improving the reliability of the air conditioner Z.

Besides, the present invention is not limited to the above-described embodiments, and it is needless to say that various modifications are possible without departing from the technical spirit.

On the other hand, the disclosed embodiments may be implemented in the form of a recording medium for storing instructions executable by a computer. The instructions may be stored in the form of a program code, and when executed by a processor, may generate a program module to perform the operations of the disclosed embodiments. The recording medium may be implemented as a computer-readable recording medium.

The computer-readable recording medium includes all kinds of recording media having stored thereon instructions which can be read by a computer. For example, there may be read only memory (ROM), random access memory (RAM), a magnetic tape, a magnetic disk, flash memory, an optical data storage device, and the like.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerant charging device for charging a refrigerant in a refrigerant flow path of an air conditioner, the refrigerant charging device comprising:

a refrigerant charging port connected to the refrigerant flow path;

a valve configured to regulate a supply of the refrigerant;

a communicator configured to perform communication with the air conditioner; and at least one processor configured to:

obtain a discharging superheat degree of the refrigerant in the air conditioner from a first refrigerant pressure and a first refrigerant temperature at a discharge side of a compressor of the air conditioner received through the communicator, obtain a subcooling degree based on the first refrigerant pressure and a second refrigerant temperature at a discharge side of an outdoor heat exchanger when the second refrigerant temperature at the discharge side of the outdoor heat exchanger provided in the air conditioner is received by the communicator, and control opening and closing of the valve based on the obtained discharging superheat degree and the obtained subcooling degree, wherein the valve is fully closed when the obtained discharging superheat degree is below a threshold value wherein the at least one processor is further configured to:

detect a refrigerant amount based on the obtained subcooling degree and a target subcooling degree; and control at least one of the opening and closing of the valve based on the detected refrigerant amount, and wherein the at least one processor is configured to:

control the valve to be opened for a preset opening time and to be closed for a preset closing time repeatedly when the obtained subcooling degree is smaller than the target subcooling degree and a difference between the obtained subcooling degree and the target subcooling degree is greater than a preset value, and control an opening time of the valve to be shorter than the preset opening time or control the closing time of the valve to be longer than the preset closing time when the obtained subcooling degree is smaller than the target subcooling degree and the difference between the obtained subcooling degree and the target subcooling degree is smaller than the preset value.

2. The refrigerant charging device of claim 1, wherein the at least one processor is further configured to control the closing of the valve when the obtained discharging superheat degree exceeds the threshold value and the obtained discharging superheat degree decreases at a change rate greater than a preset rate of change.

3. The refrigerant charging device of claim 1, further comprising a storage configured to store the target subcooling degree determined by at least one parameter selected from among an outdoor temperature, an indoor temperature, or a pipe length.

4. The refrigerant charging device of claim 1, wherein the at least one processor is further configured to control the opening time of the valve to be shortened or the closing time of the valve to be longer in proportion to the difference between the obtained subcooling degree and the target subcooling degree.

5. The refrigerant charging device of claim 1, wherein the at least one processor is further configured to control the opening time of the valve to be shortened or the closing time of the valve to be longer as an outdoor temperature decreases.

6. The refrigerant charging device of claim 1, wherein the at least one processor is further configured to change the opening time or the closing time of the valve based on a change rate of the obtained subcooling degree.

7. The refrigerant charging device of claim 1, wherein the refrigerant charging port includes:

a first refrigerant charging port provided on a liquid pipe side of the refrigerant flow path and configured to fill the refrigerant flow path with the refrigerant when the refrigerant flow path is stopped; and a second refrigerant charging port provided on a gas pipe side of the refrigerant flow path and configured to fill the refrigerant flow path with the refrigerant when the refrigerant flow path is in a cooling operation.

8. The refrigerant charging device of claim 7, wherein the at least one processor is further configured to:

obtain a charging time based on a pipe length, a number of indoor units, and an outdoor temperature when charging the refrigerant in the refrigerant flow path using the first refrigerant charging port; and control the opening of the valve during the obtained charging time.

9. The refrigerant charging device of claim 7, further comprising:

a first refrigerant charging flow path configured to charge the refrigerant in the first refrigerant charging port; and a second refrigerant charging flow path configured to charge the refrigerant in the second refrigerant charging port, wherein the valve includes:

a first valve configured to control a flow of the refrigerant when charging the refrigerant through the first refrigerant charging flow path; and a second valve configured to control a flow of the refrigerant when charging the refrigerant through the second refrigerant charging flow path, and wherein the first valve has a diameter larger than a diameter of the second valve.

10. The refrigerant charging device of claim 9, further comprising:

a communication flow path configured to communicate with the first refrigerant charging flow path and the second refrigerant charging flow path; and a filter provided in the communication flow path and configured to remove foreign matter or remove deteriorated freezer oil.

11. The refrigerant charging device of claim 1, further comprising a decompressor configured to depressurize the refrigerant to be filled in the refrigerant flow path.

12. The refrigerant charging device of claim 1, further comprising a heater configured to heat the refrigerant filled in the refrigerant flow path.

13. The refrigerant charging device of claim 1, further comprising a refrigerant charging pipe and a case in which the valve is provided, wherein the refrigerant charging port is disposed at an end of the refrigerant charging pipe and connected to the refrigerant flow path, and the valve is configured to regulate a supply of the refrigerant to the refrigerant charging pipe, and wherein the case is provided separately from the air conditioner.

14. The refrigerant charging device of claim 1, wherein the communicator is configured to perform wireless communication with the air conditioner.

* * * * *